United States Patent [19]

Shinn

[11] Patent Number: 4,894,930

[45] Date of Patent: Jan. 23, 1990

[54] ROTARY DRUM DRYER WITH NONCONDUCTING NONSTICK SURFACE

[75] Inventor: Donald E. Shinn, Independence, Kans.

[73] Assignee: Productization, Inc., Independence, Kans.

[21] Appl. No.: 267,292

[22] Filed: Nov. 4, 1988

Related U.S. Application Data

[60] Continuation-in-part of Ser. No. 125,864, Nov. 27, 1987, Pat. No. 4,802,288, which is a division of Ser. No. 33,344, Apr. 1, 1987, Pat. No. 4,729,176.

[51] Int. Cl.[4] ..... F26B 11/02

[52] U.S. Cl. ..... 34/136; 34/129; 118/303

[58] Field of Search ..... 34/33, 108, 109, 127, 34/128, 129, 130, 136; 203/86; 202/267.1; 118/303, 635

[56] References Cited

U.S. PATENT DOCUMENTS 2,319,673 5/1943 French ..... 34/128

4,703,713 11/1987 Gago et al. ..... 118/303

*Primary Examiner*—Henry A. Bennet

*Assistant Examiner*—John M. Sollecito

*Attorney, Agent, or Firm*—Hovey, Williams, Timmons & Collins

[57] ABSTRACT

An improved, high efficiency rotary drum dryer and method is disclosed which achieves outstanding thermal efficiencies by provision of a multiple-pass rotary dryer designed so that the product to be dried is first conveyed through an outermost drum of relatively large cross-sectional area and then through succeeding internal drums of progressively smaller cross-sectional areas. In this way, the velocity of induced air currents traveling through the dryer increases from pass to pass, with the result that the net velocity of product through successive passes also increases. The preferred dryer also includes housing structure in surrounding relationship to the innermost drum permitting introduction of relatively low humidity ambient-derived air into the central drum so as to lower the partial pressure of moisture in the drying atmosphere, thus promoting the final stage of drying. The preferred dryer also includes an assembly for selective introduction of a liquid or solid product treating agent into the final central drum. The dryer of the invention is capable of drying a greater volume of material with a shorter dryer and increased efficiencies are obtained because of increased airflow without attendant settling out of larger particles and possible dryer plugging.

8 Claims, 3 Drawing Sheets

ROTARY DRUM DRYER WITH NONCONDUCTING NONSTICK SURFACE

This application is a continuation-in-part of Ser. No. 125,864, filed Nov. 27, 1987, now U.S. Pat. No. 4,802,288, which is a divisional of Ser. No. 33,344, filed Apr. 1, 1987, now U.S. Pat. No. 4,729,176.

BACKGROUND OF THE INVENTION

1. Field of the Invention

The present invention is broadly concerned with an improved multiple-pass dryer useful for drying a variety of particulates such as wood furnish and agricultural products. More particularly, it is concerned with such a dryer apparatus which achieves substantially increased efficiency through use of an internal flow path arrangement serving to direct incoming, initially wet product along a serpentine flow path beginning in an outermost, relatively large cross-sectional area passageway and proceeding to successively smaller cross-sectional area passageways until dried product is removed from the apparatus. In this fashion the velocity of air currents within the drying apparatus increases as the currents pass through the dryer, whereby the velocity differential between such air currents and the saltation velocities of the particles being dried is maintained for maximum drying effect, and the net velocity of the particles moving through the dryer increases. In other aspects of the invention, apparatus is provided for the introduction of relatively dry ambient air into the innermost dryer drum to reduce the partial pressure of water vapor of the air currents passing through the dryer to increase final stage drying in the apparatus. Binders or other treating agents may also be added to the products during the final stage of drying through use of a novel addition conduit extending into the central drum of the dryer.

2. Description of the Prior Art

The drying of wood or agricultural particulates in a multiple-stage dryer is dependent upon a large number of factors, e.g., the type of product to be dried, the initial moisture content thereof, particle geometry, variable ambient conditions, dryer configuration and fuels being employed. Considerable research has been conducted in the past toward achieving maximum dryer efficiency, but in view of the relatively complex nature of the problem, the ideal dryer has yet to be developed.

In general however, the drying process involves several distinct phases or stages. That is to say, most hygroscopic materials exhibit several distinct drying rate periods as they pass through a multiple-pass dryer. Initial drying is accompanied by a warming of the material and its attendant moisture. The drying rate increases during this initial period, while the moisture content drops to a value which signals the beginning of a constant rate period of drying. During the constant rate period, moisture is evaporated from the surface of product particles at a steady rate until the surfaces are no longer entirely wet. Thereafter, a falling-off period obtains where the drying rate decreases because of the increasing difficulty of moving internal product moisture to the particle surfaces where it can be taken up and moved away. Finally, the product moisture is reduced to a point where an equilibrium is established with the surrounding atmosphere.

Conventional three-pass dryers include an elongated, horizontal, axially rotatable body having an outer drum and a series of concentric, smaller diameter drums within the outer drum. The respective drums are in communication with each other and define a serpentine flow path to the dryer. Without known exception, such dryers are provided with a product inlet oriented for directing initially wet product and hot drying air into the innermost, smallest diameter drum, whereupon the product is conveyed via induced draft currents through the outer drums until it reaches a passageway defined by the outer drum and the next adjacent inboard drum. At this point the product is in its final dried condition and is delivered for further handling or collection. Thus, conventional three-pass cylindrical dryers utilize comparatively high air velocities and temperature conditions in the innermost drum (first pass) where the incoming products are the heaviest and the wettest. Lower air velocities and lower temperatures obtain in the intermediate drum (second pass), and even lower velocities and temperatures exist in the outer drum (third pass).

This "inner drum to outer drum" configuration of conventional dryers is employed because it is believed that surface moisture evaporation is maximized in a relatively small cross-sectional area central drum where the highest air current velocity and temperature conditions exist. In the succeeding, larger diameter outer drums, it is believed that further drying is accomplished by phenomena characteristic of the falling drying rate phase. Also, the theory of conventional dryers is that the slower moving air currents in the outer drums allow larger particles to settle out and permit smaller particles to pass through, at least until the larger particles are dried enough to be picked up and conveyed by prevailing air currents.

In practice though, the relatively high air current velocity conditions in the first pass of a conventional dryer cause the wet particles to be quickly driven away from the heat source, and there is consequently a reduced opportunity for adequate heat transfer and evaporation. In subsequent passes with lower air current velocities, the particles may settle out because the prevailing air current velocities fall below the saltation velocity of the product (i.e., the minimum air current velocity needed to pick up and convey product at a given moisture level). Thus, plugging of the dryer may occur, particularly at high product flow rates, and at best the product only moves at a rate determined by the forward velocity of the slowest moving (largest) particles. The result is that the flow rate must be decreased and this inevitably has an adverse effect on drying efficiency.

The prior art also presents a problem in mixing an additive with a particulate product. For example, when resin is added to dryed wood particulates in a typical tumbling device, a layer of resin eventually builds up on the inner walls of the tumbler requiring it to be shut down and the resin manually chipped away with chisels or pneumatic hammers. This problem has prevented the introduction of such resins into the product dryer.

SUMMARY OF THE INVENTION

The present invention overcomes the problems described above and provides a unique dryer construction and method providing high drying efficiencies and the consequent ability to dry relatively large quantities of product in a small dryer utilizing reduced amounts of fuel.

Broadly speaking, the multiple-pass dryer of the invention reverses the normal dryer flow path and provides that incoming, initially wet product is directed to an outer drum having a relatively large effective cross-sectional area, whereupon the product and attendant air currents pass inwardly through drums of successively smaller effective cross-sectional areas, so that the product exits from the smallest diameter central drum.

In more detail, the preferred dryer includes an elongated, normally horizontally disposed, axially rotatable body having means defining a plurality of elongated internal passageways in communication with each other to present a continuous, serpentine flow path through the body. Advantageously, these passageways are substantially concentric and each presents a different effective cross-sectional area. A product inlet is oriented for initially directing product to be dried into an outer passageway having a relatively large effective cross-sectional area. Further, means is provided for creating currents of heated air within the body and along the flow path for conveying the product along the flow path through the relatively large effective cross-sectional area passageway, and then toward and through the smaller effective cross-sectional area passageways. A product outlet is provided in communication with a passageway having a relatively small effective cross-sectional area, generally the smallest diameter central passageway. Thus, the dryer of the invention effectively employs the novel principle of "outer drum to inner drum" operation.

In other aspects of the invention, means is provided for introducing quantities of relatively dry ambient-derived air into the innermost passageway of the dryer body, so as to lower the partial pressure of water within the air currents traveling through the dryer, thus enhancing the final stages of drying. Preferably, an elongated, rotatable tubular element is concentrically disposed about the innermost drum of the dryer to define therewith an elongated, annular zone; and an annular, arcuate, inturned air-directing flange is located at the entrance of the inner drum so as to direct the ambient air into and along the length of the passageway defined by the inner drum.

The present invention also provides apparatus for the introduction of a liquid or solid additive (e.g., water, wax, resins or organic binders) into the innermost drum passageway. Such apparatus is advantageously in the form of an elongated, rigid, non-rotating tube extending into the inner passageway adjacent the entrance end thereof.

In practice, dryers in accordance with the present invention achieve measurably increased drying efficiencies. This obtains by virtue of the "outer drum to inner drum" operation thereof which serves to successively increase the velocity of the air currents traversing the serpentine dryer flow path. This ensures that the product has an increased average net velocity in each of the successive drum passageways. As explained, this is very different from conventional dryers, wherein the average net velocity of the product decreases from passageway to passageway.

In a second embodiment, the inner walls of the third pass of the dryer are coated with an electrically non-conductive material. This provision along with the higher air velocity through the third pass results in a static electric charge on the product therein. An additive, such as a resin, is then introduced into this third pass, or treatment zone, having a static electric potential relatively opposed to that of the product for mutual attraction between the resin and the product. The introduction of relatively dry ambient air into the treatment zone enhances the static charge on the product in order to increase the mutual attraction and adherence between the additive and product in the treatment zone. As a result of the opposed static charges, the resin and the product become adhered to one another in order to produce a treated product. The additive is preferably introduced at substantially the same potential as the walls defining the treatment zone which helps inhibit accumulation of resin on these walls. The preferred coating material also has non-stick properties which further inhibits additive accumulation.

DESCRIPTION OF THE PREFERRED EMBODIMENTS

Figure 1:
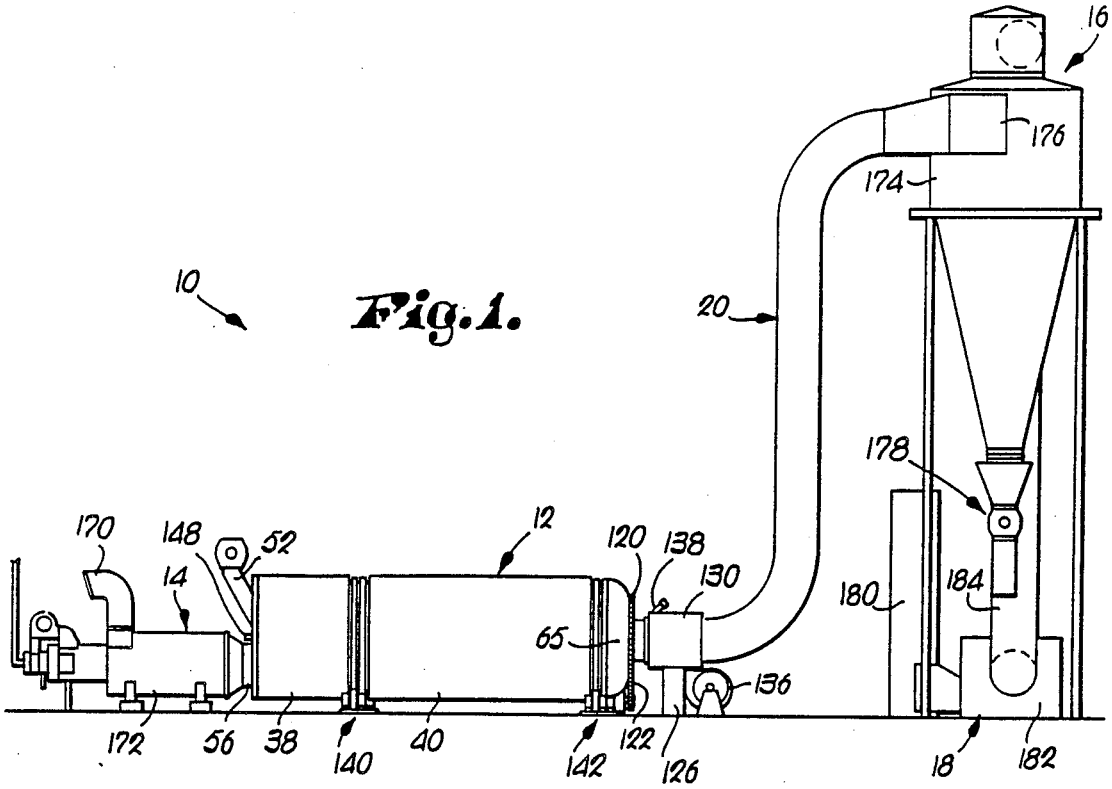
FIG. 1 is a side elevational view of a complete product drying apparatus in accordance with the present invention.

Turning now to the drawings, and particularly FIG. 1, a drying system 10 is illustrated which broadly includes a three-pass drum dryer 12 of improved construction, together with a burner 14 for supplying hot drying air to the dryer 12. In addition, the system 10 includes a cyclone separator assembly 16 having an induced draft fan unit 18 and a conduit 20 leading from the outlet of dryer 12 to the inlet of the assembly 16.

Turning now to FIGS. 2–5, it will be seen that the dryer 12 broadly includes an outer drum 22 together with a pair of internal, concentrically disposed drums 24, 26. It will be noted in this respect that the drum 22 is substantially longer than the intermediate drum 24 and central drum 26, and the importance of this feature will be explained hereinafter.

Figure 2:
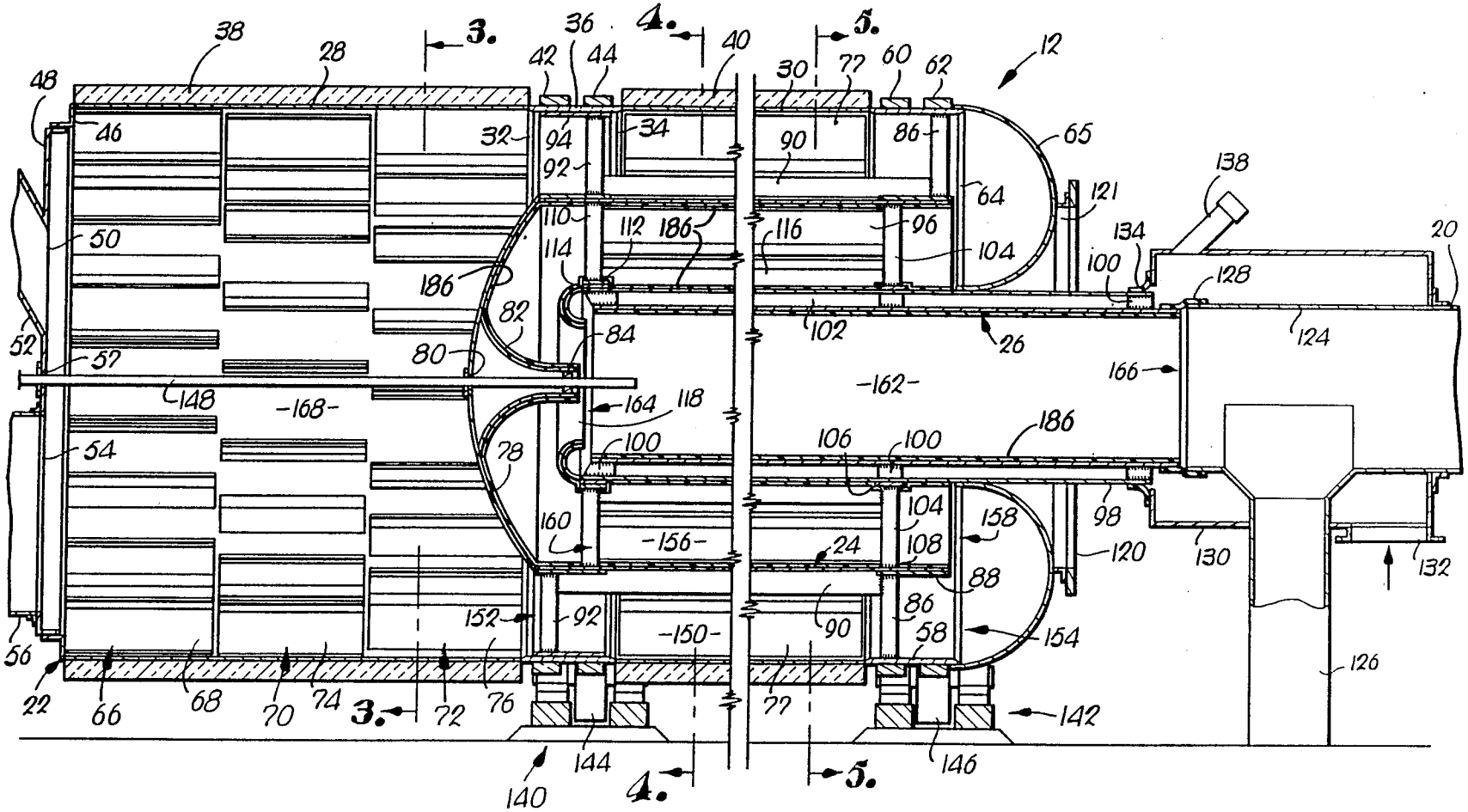
FIG. 2 is a fragmentary view in vertical section illustrating the construction of the preferred drum dryer of the invention.

In any event, outer drum 22 is in the form of an elongated, tubular metallic body made up of a pair of circular in cross-section, elongated members 28 and 30 oriented in end-to-end relationship. As best seen in FIG. 2, the righthand end of member 28 is beveled as at 32, and correspondingly the lefthand end of member 30 is beveled as at 34. A relatively short, circular in cross-section mounting ring 36 of increased thickness is interconnected with the respective adjacent beveled ends 32, 34 of the drum-defining members 28, 30, as will be readily seen. Each of the members 28, 30 is covered by external thermal insulation as at 38, 40. Ring 36 is provided with a pair of laterally spaced apart, outwardly extending metallic tracks or tires 42, 44, the function of which will be described.

The lefthand or inlet end of outer drum 22 is provided with an annular angle flange 46 (see FIG. 2) which is affixed to the extreme end of the drum member 28. A stationary circular head 48 is received by flange 46 as illustrated, and covers the end of outer rotatable drum 22. Head 48 is provided with a large, rectangular product inlet opening 50 and an integral, upwardly and obliquely extending product inlet chute 52. Moreover, head 48 includes a lower, circular inlet opening 54 for the introduction of heated drying air into the dryer. For this purpose, a tubular collar-type connector 56 is affixed to head 48 in registry with opening 54, and is designed to mate with the outlet of dryer 14. Finally, the head 48 includes a central opening 57 therethrough sized to accommodate a liquid additive conduit.

The opposite end of drum 22 is provided with a mounting ring 58 similar to the ring 36. Thus, the ring 58 is of circular cross-section, but has a thickness greater than that of the adjacent drum-defining member 30. Further, the extreme righthand end of the member 30 is beveled to facilitate connection of ring 58 thereto; and the ring 58 is provided with a pair of annular, outwardly extending mounting tires 60, 62. The outermost righthand end of the ring 58 is beveled as at 64, and the end of the drum 22 is in part closed by provision of a semi-torroidal end wall 65 affixed to the beveled end of the beveled righthand end of ring 58.

Figure 3:
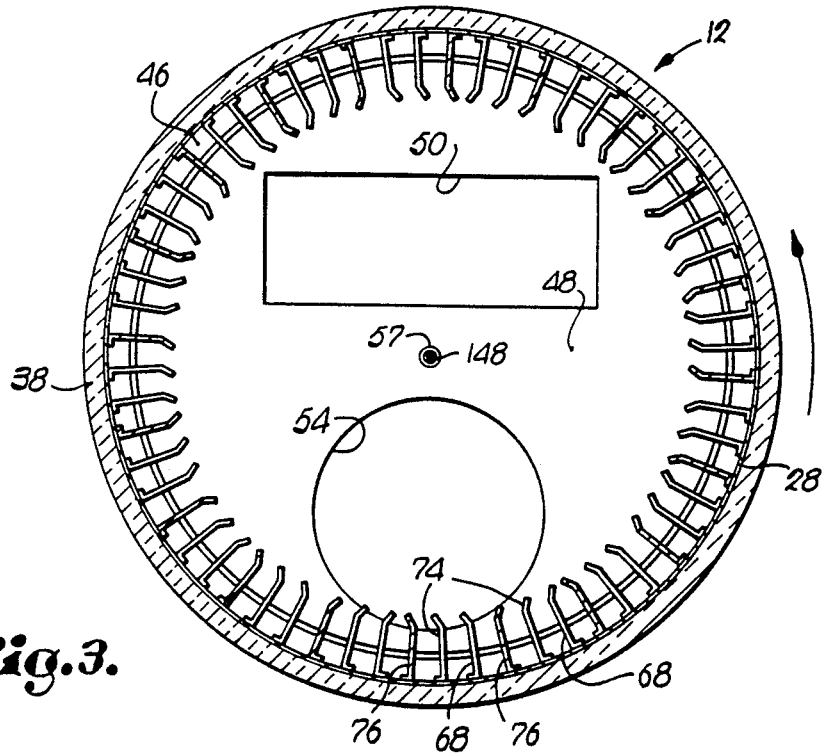
FIG. 3 is a sectional view taken along line 3—3 of FIG. 2.

The drum-defining member 28 is provided with three series of laterally adjacent, circumferentially spaced apart internal flights. Referring particularly to FIGS. 2 and 3, it will be seen that a series 66 of flights is provided adjacent head 48 and includes a plurality of inwardly extending flight members 68 spaced about the interior of the member 28. In a similar fashion, flighting series 70 and 72 are provided, respectively having circumferentially spaced apart, inwardly extending flighting elements 74 and 76. The purpose of the internal flighting within drum-defining member 28 is to initially separate and "shower" incoming, initially wet product to the dryer.

Figure 5:
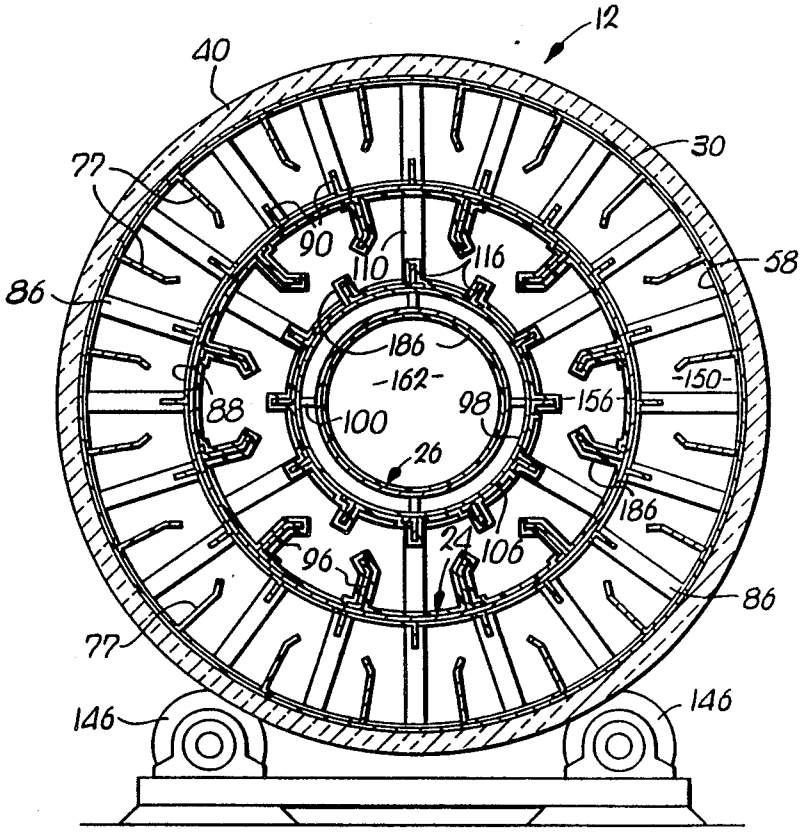
FIG. 5 is a sectional view taken along line 5—5 of FIG. 2.
Figure 4:
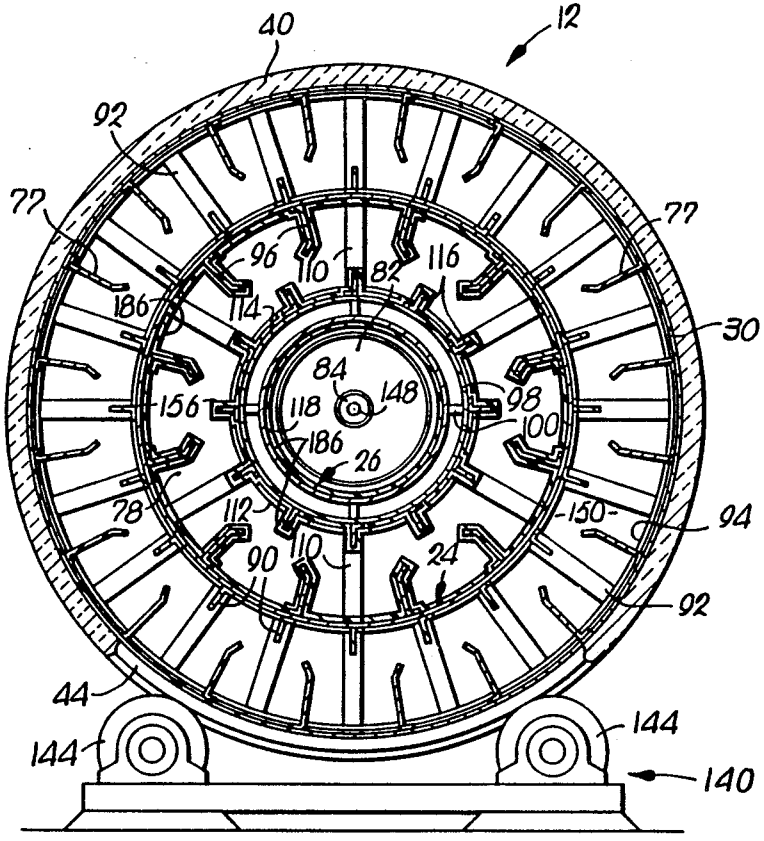
FIG. 4 is a sectional view taken along line 4—4 of FIG. 2.

On the other hand, the adjacent drum-defining member 30 has a single series of elongated, circumferentially spaced apart, inwardly extending flights 77 which are respectively affixed to the inner face of the member 30 (see FIGS. 2, 4 and 5).

The intermediate drum 24 is in the form of an elongated, circular in cross-section metallic element extending essentially the entire axial length of ring 36, member 30 and ring 58, but of a smaller diameter. An arcuate in cross-section, concavo-convex end wall 78 is attached to the lefthand end of drum 24 as seen in FIG. 2, with end wall 78 being provided with a central aperture 80 therethrough. End wall 78 further has a smoothly arcuate diverter 82 affixed to the face thereof remote from head 48 and extending toward the opposite end of the dryer 12. The diverter 82 includes an apertured bearing 84 adjacent the apex thereof, which is important for purposes to be described.

Intermediate drum 24 is supported within the drum-defining member 30 by means of a plurality of radially extending, circumferentially spaced apart struts 86 located adjacent the righthand end of the drum 24 as viewed in FIG. 2. In particular, it will be seen that a circular reinforcing plate 88 is secured to the extreme righthand end of the drum 24, with the struts 86 being welded to and extending radially outwardly from plate 88. The outboard ends of the struts 86 are welded to the inner face of guide ring 58. In order to provide further strength and rigidity, elongated, axially extending angle ribs 90 are affixed to the outer face of drum 24 and are oriented in a circumferentially spaced relationship (see FIG. 5). In this respect, it will be noted that the angles 90 are oriented with the struts 86.

The opposite end of drum 24 adjacent end wall 78 is likewise supported by means of radially outwardly extending, circumferentially spaced apart struts 92. These struts are welded to end wall 78 as shown and extend outwardly therefrom. The outboard ends of the struts 92 are also welded to a circular ring 94 which is situated adjacent the inner face of mounting ring 36. However, there is no interconnection between the rings 94, 36, in order to accommodate thermal expansion and contraction of the components making up the dryer 12.

The inner face of drum 24 has a series of lifting and separating flights 96 which are oriented in circumferentially spaced relationship and extend inwardly toward the center of drum 12.

Central drum 26 is in the form of a metallic body extending substantially the length of the member 30 but projecting beyond the end of the latter for a short distance as illustrated in FIG. 2. A circular in cross-section, radially enlarged housing 98 is concentrically disposed about drum 26, and is fixedly secured thereto by means of a series of spacers 100. Thus, an elongated, annular zone 102 is defined between the exterior face of drum 26 and the interior face of housing 98.

The drum/housing composite made up of the interconnected drum 26 and housing 98 is supported adjacent the righthand end of dryer 12 as seen in FIG. 2 by means of plural, circumferentially spaced, radially outwardly extending struts 104. The struts 104 are welded to a narrow, circular reinforcing ring 106, the latter being in turn welded to the outer face of housing 98. The opposite ends of the struts 104 are welded to the inner face of drum 24 as at 108. The inner, lefthand end of drum 26 is supported by plural, circumferentially spaced apart, radially outwardly extending struts 110. In this case, the respective struts 110 are welded to a narrow circular ring 112 which is positioned in closely adjacent, surrounding relationship to a similarly dimensioned ring 114 secured to the extreme lefthand end of housing 98. However, there is no mechanical connection between the adjacent rings 112, 114.

The outer face of housing 98 carries a plurality of reinforcing angle ribs 116 which extend between the struts 104, 110 as depicted. These ribs 116 are oriented in an evenly circumferentially spaced fashion about housing 98. Also, the inner circular margin of end wall 65 is affixed to housing 98 as illustrated.

The inboard end of housing 98 includes a circular, arcuate in cross-section diverter 118 which is affixed to the housing and extends inwardly beyond drum 26 so that air passing through the zone 102 is diverted for passage into and along the length of central drum 26.

A drive sprocket 120 having a reinforcing angle 121 bolted thereto is secured by means of welding to the wall 65, in order to rotate the central drum 26 and, by virtue of the described interconnections, the entirety of drum 12. For this purpose, the overall drum assembly includes a chain 122 trained around sprocket 120, with the chain being operatively coupled to a drive motor.

The extreme righthand end of drum 26 terminates adjacent a stationary plenum box 124. The box 124 includes a heavies drop-out chute 126, and is coupled to conduit 20. Further, a flexible seal 128 is provided between the end of drum 20 and the inlet of stationary box 124 to effect a rotating seal between these members.

An enlarged secondary plenum box 130 is disposed in surrounding relationship to box 124 and is provided with a lower ambient air inlet 132. A flexible seal 134 is provided between the extreme righthand end of housing 98 and the outlet of plenum box 130. A blower assembly 136 (see FIG. 1) is situated below box 130 and is operatively coupled to air inlet 132. Finally, box 130 is equipped with a water injection port 138 so as to permit selective injection of moisture into air currents within the outer plenum box.

The complete dryer 12 is mounted for axial rotation by means of a pair of mounting assemblies 140, 142 respectively located beneath the rings 36, 58. Each of the mounting assemblies 140, 142 includes a pair of spaced apart, axially rotatable trunnions 144 and 146. The trunnions 144, 146 are respectively in engagement with the tires 42, 44 and 60, 62. The preferred drum mounting structure used in the preferred embodiment of the invention is fully described in copending Application for U.S. Letters Patent Ser. No. 06/877,531, filed June 23, 1986 and entitled "Mounting Structure for Rotary Drum Dryer." This application is incorporated by reference herein.

Dryer 12 is also provided with an elongated addition conduit 148 which extends from a point outside of the dryer through opening 57 of head 48 and member 28. The inner end of the conduit 148 is received by bearing 84, and extends to a point just inside the lefthand end of central drum 26 (see FIG. 2). Conventional metering equipment may be coupled to the exterior end of conduit 148 for the purpose of metering liquid or solid additives into drum 26 as desired.

From the foregoing discussion, it will be appreciated that the overall drum assembly 12 presents an elongated, normally horizontally disposed, axially rotatable body with the drums 22, 24 and 26 cooperatively defining a plurality of internal passageways intercommunicated to present a continuous serpentine flow path. In particular, it will be seen that dryer 12 includes an elongated, annular in cross-section outermost flow passageway 150 having an entrance end 152 and an exit end 154 which is defined between the member 30 and drum 24; an elongated, annular in cross-section intermediate passageway 156 having an entrance end 158 and an exit end 160 and being defined between drum 24 and housing 98; and an innermost, central, circular in cross-section passageway 162 presenting an entrance end 164 and an exit end 166. Moreover the member 28 and head 48 cooperatively define a large premixing zone 168 for initially wet product and heated air. As will be readily appreciated, provision of walls 65 and 78 ensures that flow of product and air currents through the dryer 12 must proceed through the passageways 150, 156 and 162, rather than being short circuited directly to any of the inner passageways. In general therefore, product to be dried and induced air currents first pass through premixing zone 168 and thence in serial order through outer passageway 150, intermediate passageway 156 and central passageway 162 before leaving the dryer via exit end 166.

Burner 14 is of essentially conventional construction and may be any one of a series of commercially available burners. In general, the burner 14 would include an air inlet 170 leading to a fuel-fired burner chamber 172 which communicates with connector 56. One burner useful in the context of the present invention is that sold by Guaranty Performance Co. of Independence, Kan. as a "ROEMMC" burner.

Assembly 16 includes a conventional cyclone separator 174 having an inlet 176 and a lower product outlet 178. The separator 174 is located in an elevated position, and conduit 20 extends between plenum box 124 and inlet 176, as those skilled in the art will readily appreciate.

Fan unit 18 is positioned at grade and includes a large industrial fan 180 having an air outlet stack 182. The inlet to fan 180 is connected to the upper end of cyclone 174 by means of upright conduit 184. In operation, fan unit 18 serves to draw ambient air into burner chamber 172 through inlet 170, whereupon such air is heated and pulled through the previously described internal flow path of burner 12. Inasmuch as product is simultaneously delivered to dryer 12 (advantageously in a dispersed sheet-like fashion through the large opening 50), it will be appreciated that such product is conveyed through the dryer by means of the induced air currents created by fan 18. Furthermore, such negative pressure currents convey dried product from dryer 12 through conduit 20 for ultimate separation in cyclone 174 and later collection.

The described dryer construction gives a number of significant advantages in operation. As is evident from the foregoing, the dryer first of all provides a product flow path which is the reverse of conventional units, i.e., the product passes into and through the outermost passageway 150 and thence through the successive inner passageways 156 and 162. The outer passageway 150 has a maximum effective cross-sectional area, whereas the inboard passageways 156, 162 have progressively smaller effective cross-sectional areas. As a consequence, it will be appreciated that induced air currents passing along the dryer flow path increase in velocity as they proceed from the outer to the inner passageway. This means that the net velocity of the product conveyed along the dryer flow path increases. Thus, while the velocity of product may decrease or vary within a given passageway, the net velocity of the product increases as the product moves to and through the successive passageways.

Provision of the blower assembly 136, plenum box 130, annular zone 102 and diverter flange 118 also permits ready introduction of relatively low humidity, ambient-derived air into the final dryer passageway 162. Thus, if desired relatively dry air from the atmosphere may be directed into entrance end 164 of the passageway 162 for mixing with the heated, humid air currents passing through the final dryer passageway. Inasmuch as a reduction in the humidity of the airstream within passageway 162 causes a corresponding reduction in the partial pressure of the water vapor in the combined airstream, enhanced drying is obtained, because a greater differential vapor pressure between moisture in the product and moisture in the surrounding atmosphere is developed. It will be noted in this respect that the ambient-derived air is preheated within zone 102 by virtue of indirect heating through the walls of housing 98 and drum 26. Furthermore, provision of the diverter 118 ensures that the ambient-derived air enters passageway 162 at a substantial velocity and with sufficient turbulence to promote proper mixing between the low humidity ambient air and the relatively high humidity induced air currents.

If it is desired to add a treating agent in the final passageway 162, such is accomplished through use of the conduit 148. It will be observed in this respect that the outlet end of the conduit 148 is strategically located relative to diverter flange 118 so that the turbulent conditions created adjacent the flange can be employed to enhance mixing of the treating agent with the air/-product stream.

The present invention provides a number of operational advantages which cannot be duplicated in the prior art. In order to illustrate certain of these advantages, the following calculated hypothetical example is provided which compares the drying characteristics of a 12 foot diameter by 60 foot long dryer in accordance with the present invention versus a 12 foot diameter by 60 foot long three-pass dryer of conventional design. Table 1 presents the calculated data for the dryer in accordance with the invention, whereas Table 2 presents corresponding data for the conventional dryer.

TABLE 1

Temperature, Humidity, and Moisture gradients for a 12 ft. diameter by 60 ft. long improved continuous dryer in accordance with the invention:

| | Gas Temp. (°F.) | Specific Humidity (%) | Gas Velocity (F/min) | Solids Temp. (°F.) | Solids Moisture (% by wt) | Solids Velocity (f/min) |
|---|---|---|---|---|---|---|
| Pass 1 Station | | | | | | |
| 0.00 | 1,100 | 0.04612 | 1,376 | 35 | 1.00010 | 24.01 |
| 15.00 | 883 | 0.07214 | 2,359 | 163 | 0.81312 | 34.48 |
| 30.00 | 690 • | 0.09867 | 2,119 | 212 | 0.62259 | 45.14 |
| 45.00 | 477 | 0.12659 | 1,812 | 212 | 0.42206 | 56.37 |
| Pass 2 Station | | | | | | |
| 0.00 | 284 | 0.15173 | 2,381 | 221 | 0.24153 | 57.47 |
| 15.00 | 273 | 0.15822 | 2,371 | 230 | 0.19486 | 66.53 |
| 30.00 | 261 | 0.16471 | 2,356 | 240 | 0.14825 | 75.62 |
| 45.00 | 250 | 0.17139 | 2,345 | 249 | 0.10031 | 84.56 |
| Pass 3 Station | | | | | | |
| 0.00 | 212 | 0.17528 | 6,149 | 212 | 0.07237 | 3,809 |
| 15.00 | 210 | 0.15011 | 7,165 | 210 | 0.06151 | 4,825 |
| 30.00 | 208 | 0.15138 | 7,158 | 208 | 0.05076 | 4,818 |
| 45.00 | 206 | 0.15264 | 7,151 | 206 | 0.04001 | 4,811 |

| Drying Process Summary: | Infeed | Output |
|---|---|---|
| Moisture (%) | 1.00010 | 0.04001 |
| Solids (lb/hr) | 40,000 | 40,000 |
| Water (lb/hr) | 40,004 | 1,600 |
| Total (lb/hr) | 80,004 | 41,600 |
| Evaporation (lb/hr) | | 38,404 |
| Exhaust Air Vol. | = | 97,501 ACFM |
| Heat Required[1] | = | 59,610,115 BTU/hr |
| Specific Th. Energy[1] | = | 1,552 BTU/lb evap |
| Th. Efficiency[1] | = | 0.7438 |

[1]Basis for heat content is Fuel G.C.V. (gross clorific value)

TABLE 2

Temperature, Humidity, and Moisture gradients for a 12 ft. diameter by 60 ft. long improved continuous dryer in accordance with the invention:

| | Gas Temp. (°F.) | Specific Humidity (%) | Gas Velocity (F/min) | Solids Temp. (°F.) | Solids Moisture (% by wt.) | Solids Velocity (F/min) |
|---|---|---|---|---|---|---|
| Pass 1 Station | | | | | | |
| 0.00 | 1,100 | 0.04612 | 5,044 | 35 | 1.00010 | 652.1 |
| 15.00 | 1,024 | 0.05480 | 4,879 | 83 | 0.93310 | 613.4 |
| 30.00 | 951 | 0.06231 | 4,706 | 121 | 0.87521 | 573.2 |
| 45.00 | 883 | 0.07065 | 4,550 | 163 | 0.81097 | 533.8 |
| Pass 2 Station | | | | | | |
| 0.00 | 791 | 0.09342 | 2,611 | 210 | 0.63544 | 13.54 |
| 15.00 | 674 | 0.11744 | 2,468 | 225 | 0.45027 | 19.08 |
| 30.00 | 553 | 0.14042 | 2,292 | 230 | 0.27315 | 25.48 |
| 45.00 | 431 | 0.15526 | 2,065 | 236 | 0.15876 | 37.13 |
| Pass 3 Station | | | | | | |
| 0.00 | 371 | 0.16025 | 1,385 | 240 | 0.12023 | 22.61 |
| 15.00 | 330 | 0.16417 | 1,325 | 244 | 0.09002 | 21.35 |
| 30.00 | 289 | 0.16676 | 1,261 | 246 | 0.07010 | 20.02 |
| 45.00 | 250 | 0.17066 | 1,203 | 250 | 0.04001 | 18.23 |

TABLE 2-continued

Temperature, Humidity, and Moisture gradients for a 12 ft. diameter by 60 ft. long improved continuous dryer in accordance with the invention:

| Drying Process Summary: | Infeed | Output |
|---|---|---|
| Moisture | 1.00010 | 0.04001 |
| Solids (lb/hr) | 27,000 | 27,000 |
| Water (lb/hr) | 27,003 | 1,080 |
| Total (lb/hr) | 54,003 | 28,080 |
| Evaporation (lb/hr) | | 25,923 |
| Exhaust Air Vol. | = | 63,720 ACFM |
| Heat Required[1] | = | 43,187,718 BTU/hr |
| Specific Th. Energy[1] | = | 1,666 BTU/lb evap |
| Th. Efficiency[1] | = | 0.5926 |

[1]Basis for heat content is Fuel G.C.V. (gross clorific value)

The following is an analysis of the foregoing data with an explanation of the advantages which inhere in the dryer design of the present invention.

First Pass

In the dryer of the present invention the bulk of the moisture is removed in the outer (first pass) drum where the particles are held below their saltation velocities which, in this example, will vary from about 4,400 feet per minute when wet to 2,350 feet per minute when dry (Table 1, column 4). A high velocity differential period is employed in the first pass.

By contrast, in the conventional dryer, the wet particles are driven away from the heat source at a net forward velocity of approximately 600 feet per minute to the rear of the inner (first pass) drum (Table 2, column 4). Because the particles will travel this distance in under 6 seconds, there is little opportunity for transfer of heat to the particle or for transfer of moisture from the particle (Table 2, column 6). Even though the velocity differential is great, the duration is very short resulting in a low velocity differential period.

Second Pass

In the dryer of the invention, partially moist particles will begin to convey at a point in the intermediate (second pass) drum where their decreasing saltation velocities (due to decreasing density) balance with the air velocity. Those nearly dry particles will be conveyed at a low enough net forward velocity to provide time enough to completely remove their moisture. The already dry particles are being conveyed because their saltation velocities are less than the air velocity.

In the conventional dryer, the bulk of the material is dried in the intermediate (second pass) drum (Table 2, column 6). Notice that air velocities are below the minimum saltation velocity for both the dry and partially moist particles, throughout the second pass (Table 2, column 4). Here particles "settle out" and "drifting" occurs. There is a maximum material flow which will exit this pass; if a material flow greater than this is admitted into this region, plugging will occur with possible disastrous effects. Volatizing of the surface molecules of dry particles may result in either their decomposition causing an ensuing air pollution control problem, or the elevation of their surface temperatures to their flash points resulting in their combustion and an ensuing "dryer fire."

Third Pass

Material entering the inner cylinder (blending zone) of the dryer of the invention is quickly accelerated at the blending nozzle (Table 1, column 6). Lower humidity, temperature controlled air entering at this interface causes both a highly turbulent blending zone providing intimate contact with the near dry material and any additives or binding agents introduced here as well as providing a lower humidity region causing an increased partial pressure differential between the particle and its atmosphere resulting in the attainment of the desired moisture content without any additional heat requirement.

In the conventional dryer, the mass of particles (both dry and moist) will slowly advance (below saltation velocities) through the outer (final pass) drum, provided they were able to round the corner from the second pass to the final pass. The final moisture is removed here. While the bulk temperature of the solids appear favorable, dryer particle surface temperatures may be elevated to the 330 degree to 370 degree range near the entry of this pass because they were unable to exit the flow when adequately dried. Here again, volatization or combustion of these particles may occur. Finally, the dried material will be brought into contact with the exit conveying duct by lifting flights as the dryer rotates.

In sum therefore, greater velocity differential periods are maintained between the hottest gases and the wettest material in the dryer of the invention, providing more rapid heat and mass transfer by correctly utilizing the material to gas density relationship and holding the material below saltation velocity until dry.

When dry, a material will reach a saltation velocity. It is important at this point to provide a gas velocity sufficient to pick up the particle and pneumatically convey it out of the drying environment. The dryer of the invention accomplishes this whereas a conventional drum allows the material to "settle out" which may result in "blue haze", plugging, or a dryer fire.

Increased efficiency is possible because of greater airflow through the dryer of the invention. On the other hand, an increased airflow through a conventional dryer merely results in more rapid advancement of the moist material away from the heat source and more intense packing at the point of material "drop out" from the flow stream.

DESCRIPTION OF THE SECOND EMBODIMENT

Those skilled in the art will appreciate that pneumatic conveyance of relatively dry particulate products creates a static charge on the product relative to the conveying pipe. This has been perceived as a problem and disadvantage requiring grounding of metallic components in order to prevent static charge buildup. The second preferred embodiment of the present invention, however, includes coating 186 on the inner, product-contact walls of intermediate and central drums 24, 26 in order to enhance the static electric charge creating ability of dryer 12.

As discussed above, the air velocity and product velocity through dryer 12 increases as the product and air currents pass through the flow path through drums 22, 24, and 26. Additionally, the product becomes dryer as it progresses through the flow path such that the combination of high velocity and dry product through intermediate drum 24, and in particular central drum 26, results in a buildup of static electric potential on the product in relation to the walls of dryer 12 which are at ground potential. The static charge buildup can be enhanced by the introduction of relatively dry ambient air through air inlet 132. This ambient air is typically of lower relative humidity which further increases the ability of system 10 to build a static electric charge on the product.

In the preferred embodiment, additives can be introduced through conduit 148 at an additive entry point just inside the lefthand end of central dryer 26 (see FIG. 2). Conduit 148 is preferably composed of metal as is dryer 12 and are at the same static electric potential, that is, ground potential, by virtue of electrical interconnections therebetween such as that provided by bearing 84, mounting assemblies 140, 142, and separate electrical connections to ground if needed. Additives introduced through conduit 148 also at ground potential and a relative static electrical potential difference exists between the resin as it is introduced into drum 26 and the product therein. This potential difference results in mutual attraction between the resin and the product within drum 26 which is the preferred treatment zone. This mutual attraction, in turn, results in mutual adherence so that the resin uniformly coats the individual particles of the product.

The resin is inhibited from collecting on the walls of drum 26 because both are at the same ground potential, and because the resin is attracted to the product instead. Coating 186 is preferably a high molecular weight synthetic resin material, or TFE known by the brand name TEFLON. These preferred materials, in addition to non-conductivity, present a relatively non-stick surface which further minimizes any additive buildup on the walls of the treatment zone.

Having thus described the preferred embodiments of the present invention, the following is claimed as new and desired to be secured by Letters Patent.

I claim:

1. A device for treating a particulate product with an additive for producing a treated product, said device comprising:

a rotatable body having walls defining:
- a continuous, product flow path through said body,
- a product inlet for directing product to be treated into said flow path,
- a product outlet for recovering treated product from said flow path,
- an additive entry between said inlet and outlet for introducing an additive into said flow path, and
- a treatment zone in said flow path between said additive entry and said product outlet;

a coating of electrically non-conducting material on at least those of said walls defining said treatment zone;

means for creating air currents within said body and along said flow path for conveying said product in a co-current fashion from said inlet to said outlet, and for creating a static electric potential difference between said product within said treatment zone and said zone-defining walls; and means for introducing said additive into said flow path through said additive entry and into said treatment zone with said additive and product having a static electric potential difference therebetween for mutual attraction and adherence in order to produce said treated product.

2. The device as set forth in claim 1, said additive having substantially the same static electric potential as said zone-defining walls for inhibiting adherence of said additive thereto.

3. The device as set forth in claim 1, further including means for heating said air currents for drying said product during conveyance along said flow path.

4. The device as set forth in claim 3, further including means for introducing ambient air into said flow path for mixing with said heated air currents in order to lower the relative humidity thereof.

5. The device as set forth in claim 1, said flow path presenting a flow path portion between said inlet and additive entry, said treatment zones presenting a cross-sectional area less than the cross-sectional area of said flow path portion for increased air current velocity therethrough relative to said flow path portion for enhancing the creation of said static electric potential on said product.

6. The device as set forth in claim 1, said coating material including TFE.

7. The device as set forth in claim 1, said coating material presenting a non-stick surface relative to said additive for inhibiting adherence of said additive to said zone-defining walls.

8. The device as set forth in claim 1, said additive including a liquid resin.

* * * * *